United States Patent [19]

Ling

[11] Patent Number: 5,063,761

[45] Date of Patent: Nov. 12, 1991

[54] SIMPLY-CONSTRUCTED COMBINATION PADLOCK

[76] Inventor: Chong-Kuan Ling, c/o Sinox Co., Ltd., P.O. Box 53-58, Taipei, Taiwan

[21] Appl. No.: 710,757

[22] Filed: Jun. 3, 1991

[51] Int. Cl.[5] ..... E05B 37/06

[52] U.S. Cl. ..... 70/25; 70/315

[58] Field of Search ..... 70/24, 25, 312–318

[56] References Cited

U.S. PATENT DOCUMENTS

| | | | |
|---|---|---|---|
| 1,499,554 | 7/1924 | Rule | 70/25 |
| 1,823,650 | 9/1931 | Gordon | 70/25 |
| 1,920,250 | 8/1933 | Diaz | 70/25 |
| 1,964,936 | 7/1934 | Denerich | 70/25 |
| 2,160,698 | 5/1939 | Herbert | 70/25 |
| 2,220,148 | 1/1940 | Eber | 70/25 |
| 3,766,758 | 10/1973 | Heine et al. | 70/25 |
| 3,983,724 | 10/1976 | Foote | 70/25 |
| 4,719,776 | 1/1988 | Molnar | 70/316 X |
| 4,733,548 | 3/1988 | Ling | 70/25 |
| 4,887,441 | 12/1989 | Ling | 70/25 |

*Primary Examiner*—Gary L. Smith
*Assistant Examiner*—Suzanne L. Dino

[57] ABSTRACT

A combination padlock includes: a first lock body combinable with a second lock body having a hollow spindle formed in the second lock body, a shackle generally U shaped having two leg members respectively lockably embedded in the two lock bodies, a plurality of dials rotatably mounted on the hollow spindle of the second lock body, a plurality of sleeves each sleeve rotatably engageable with each dial, a locking bolt slidably held in the hollow spindle normally locking one leg member of the shackle for locking the padlock, and at least a combination-changing pin preformed in situ in one lock body, whereby upon an inward depression of the pin to disengage the sleeves from the dials, the dials can be freely rotated for resetting a new combination conveniently.

2 Claims, 5 Drawing Sheets

SIMPLY-CONSTRUCTED COMBINATION PADLOCK

BACKGROUND OF THE INVENTION

U.S. Pat. No. 4,887,441 also invented by the present inventor entitled "Quickly Openable Combination Padlock of Push-button Type" includes a shackle ejector and a push-button slide provided in a lock casing whereby upon a depression of a push button of the push-button slide to disengage a shackle from the slide, a resilience of the shackle ejector will eject a free end of a shackle for a quick opening of the padlock.

However, such a combination padlock will require a larger space for installing the push-button slide and the shackle ejector in the lock casing and will increase its assembly inconvenience and production cost.

Whenever changing a combination after opening the lock and if the shackle 2 is not precisely rotated at a right angle to allow its lower inclined surface 212*a* ready for thrusting the flange 302 of the shaft 30, the sleeves 4 may not be inwardly depressed to disengage from the dials 3, thereby being unable to change or re-set a new combination.

The present inventor has found the defects of his previous patent and invented the present padlock with simpler construction.

SUMMARY OF THE INVENTION

The object of the present invention is to provide a combination padlock including: a first lock body combinable with a second lock body having a hollow spindle formed in the second lock body, a shackle generally U shaped having two leg members respectively lockably embedded in the two lock bodies, a plurality of dials rotatably mounted on the hollow spindle of the second lock body, a plurality of sleeves each sleeve rotatably engageable with each dial, a locking bolt slidably held in the hollow spindle normally locking one leg member of the shackle for locking the padlock, and at least a combination-changing pin preformed in situ in one lock body, whereby upon an inward depression of the pin to disengage the sleeves from the dials, the dials can be freely rotated for resetting a new combination conveniently.

Another object of the present invention is to provide a simply-constructed combination padlock including two lock bodies combinable each other for rotatably mounting a plurality of dials on a spindle formed in one lock body, a shackle generally U shaped having two leg members normally locked in the two lock bodies by a locking bolt slidably held in the spindle having a locking ball rotatably retained on an outer end of the locking bolt and normally engageable with an arcuate recess formed in a free leg member of the two leg members for normally locking the padlock.

DETAILED DESCRIPTION

Figure 2:
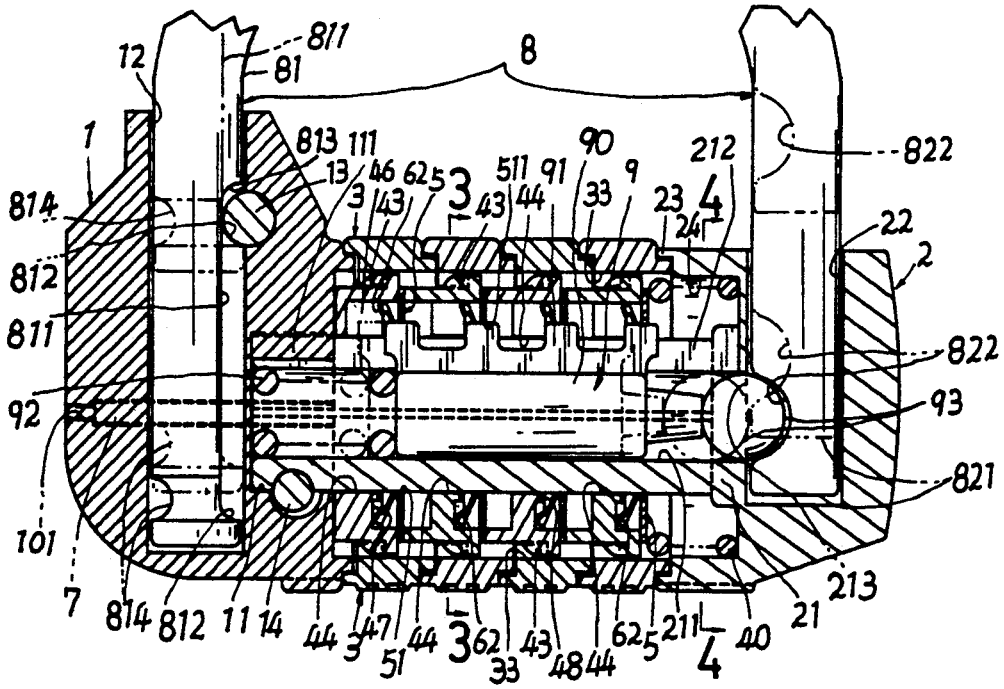
FIG. 2 is a sectional drawing of the present invention at an openable state.

As shown in FIGS. 1–7, the present invention comprises: a first lock body 1, a second lock body 2 combinable with the first lock body 1 having a shackle 8 generally U shaped linked between the two lock bodies 1, 2, a plurality of dials 3 and sleeves 4 rotatably mounted in between the two lock bodies 1, 2, a plurality of spacers 5 respectively partitioning the sleeve 4, a plurality of sensing positioner plates 6 each plate 6 rotatably clickingly engageable with each sleeve 4 for operatively sensing a subsequent dialing operation on every number of the combination numbers, a combination-changing means 7 for re-setting a new combination, and a locking means 9 normally locking the shackle 8 for locking the padlock of the present invention.

The first lock body 1 includes: a spindle socket 11 horizontally recessed in an inner side portion of the first lock body 1 facing the second lock body 2, a first annular extension 15 disposed around the spindle socket 11, a first shackle hole 12 vertically formed in the first lock body 1 for slidably holding a first leg member 81 of the shackle 8 in the hole 12, an upper rivet 13 transversely formed in an upper portion of the lock body 1, and a lower rivet 14 transversely formed in a lower portion of the lock body 1.

The second lock body 2 includes: a hollow spindle 21 protruding inwardly from the lock body 2 towards the first lock body 1, a second shackle hole 22 vertically formed in the lock body 2 for slidably holding a second leg member 82 of the shackle 8 in the hole 22, a second annular extension 23 circumferentially formed on an inner side portion of the lock body 2 facing the first lock body 1, and a spring socket 24 horizontally recessed in the inner side portion of the body 2 annularly defined between the spindle 21 and the extension 23.

Figure 4:
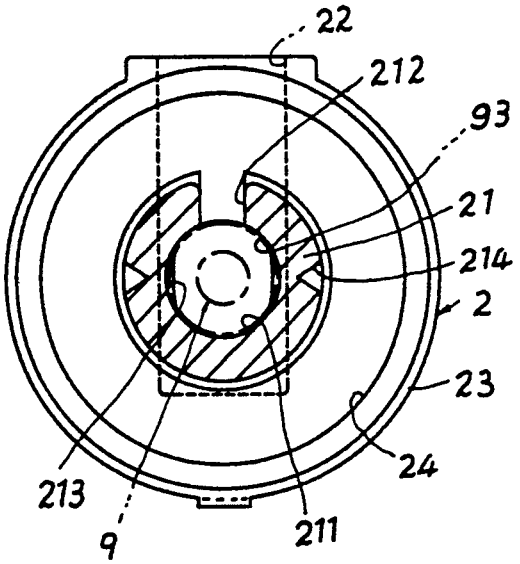
FIG. 4 is a sectional drawing of the present invention when viewed from 4—4 direction of FIG. 2.

The hollow spindle 21, especially as shown in FIG. 4, includes: a central bolt hole 211 longitudinally formed in the spindle 21 perpendicular to and communicated with the second shackle hole 22, a longitudinal slot 212 longitudinally formed in an upper portion of the spindle 21 communicated with the bolt hole 211, two meniscus extensions 213 formed on two side portions of the bolt hole 211 at an interface between the bolt hole 211 and the shackle hole 22, and two positioning grooves 214 each groove 214 longitudinally recessed in the hollow spindle 21.

An innermost end of the spindle 21 is engaged with the spindle socket 11 in the first lock body 1 and is secured by the lower rivet 14 for combining the two lock bodies 1, 2. A lug 111 radially formed on the first lock body 1 engaged with the slot 212 of the spindle 21 also help the combining of the two bodies 1, 2.

Each dial 3 generally formed as a cylindrical collar includes: a plurality of numerals 31 (for instance, 0, 1, 2, - -9) circumferentially formed on an outer cylindrical surface of the dial 3, and an anner ring 32 formed inside the dial 3 having a plurality of recesses 33 annularly formed in the ring 32. Each recess 33 is corresponding to each numeral 31 of the dial 3.

Each sleeve 4 includes a central hole 41 rotatably engageable with an outer cylindrical surface of the hollow spindle 21, a flange 42 rotatably held in the dial 3 having a plurality of protrusions 43 formed in an outer cylindrical surface of the sleeve 4 adjacent to the flange 42 to be engageable with the recesses 33 formed in the inner ring 32 of dial 3, an inner ring 44 circumferentially formed on a central portion of an inner cylindrical surface inside the sleeve 4 defining the central hole 41, an annular shoulder portion 45 formed on an end portion of each sleeve 4, an opening slot 46 formed through the inner ring 44 corresponding to the longitudinal slot 212 of the spindle 21 for slidably moving a plurality of projections 91 formed on the locking means 9, a plurality of dial-sensing recesses 47 annularly formed in the inner ring 44 each recess 47 rotatably projectively corresponding to each numeral 31 formed on the dial 3, and a plurality of annular corrugated teeth 48 annularly formed on the inner ring 44. Each projection 91 is normally rotatably held within a cavity defined between two inner rings 44 of two neighbouring sleeves 4.

Figure 1:
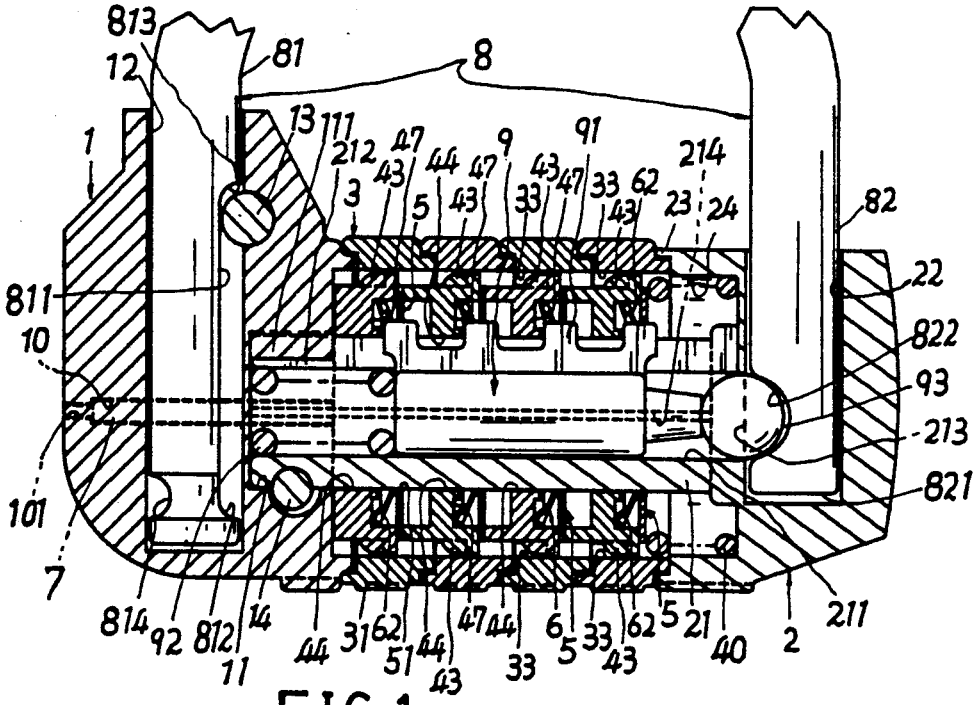
FIG. 1 is a sectional drawing of the present invention when locked.
Figure 3:
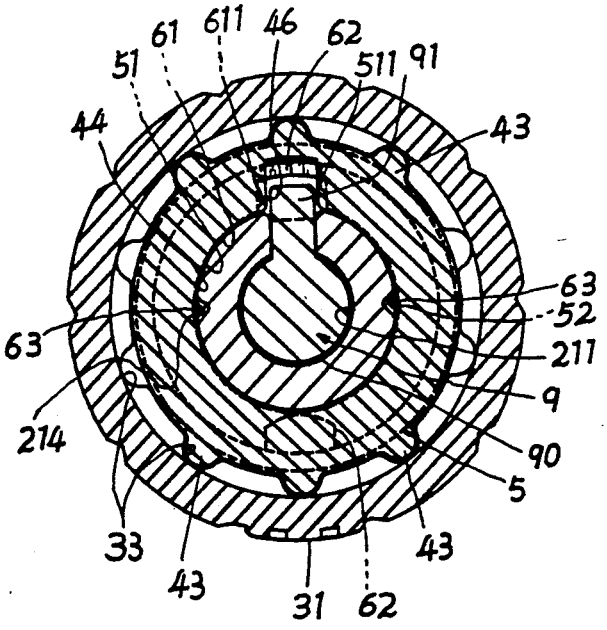
FIG. 3 is a sectional drawing of the present invention when viewed from 3—3 direction of FIG. 2.
Figure 5:
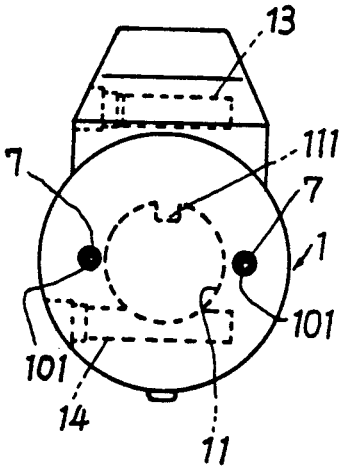
FIG. 5 is a left side view of the present invention as shown in FIG. 2.

A sleeve tensioning spring 40 is provided in the spring socket 24 to normally urge the spacers 5 and the sleeves 4 leftwardly as shown in FIG. 1 to allow the protrusions 43 to be engageably retained on the recesses 33 of the dial 3. All sleeves 4 are leftwardly limited by the first lock body 1.

Each spacer 5 is formed with a central guide hole 51 slidably engageable with the spindle 21, and a projection notch 511 notched in the hole 51 for sliding the projections 91. The spacers 5 are each provided for partitioning every two neighbouring sleeves 4, in which a right-end spacer 5 is resiliently retained by the spring 40.

Each sensing positioner plate 6 has a cross section generally arcuate shaped with its annular periphery slightly bent, and includes a central guide hole 61 slidably engageable with the spindle 21, and a projection notch 611 notched in the hole 61 for slidably engaging the projections 91. Each plate 6 is inserted in between each sleeve 4 and each spacer 5. A plurality of sensing protrusions 62 are annularly formed on a periphery of the plate 6 each protrusion 62 resiliently engageable with each dial-sensing recess 47 corresponding to each numeral 31 formed on dial 3 as urged by spring 40 and spacer 5.

Figure 6:
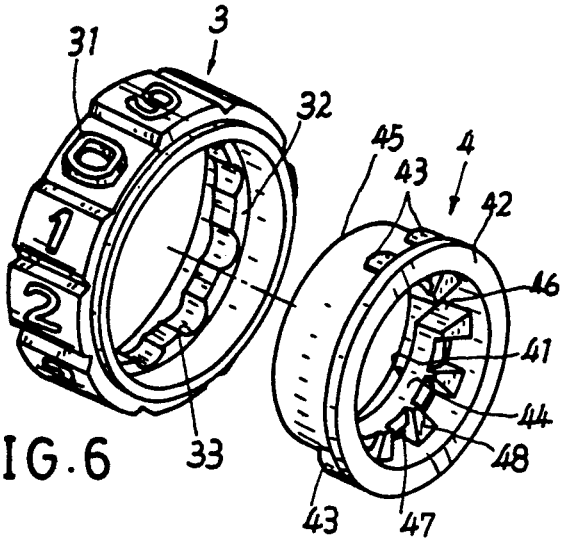
FIG. 6 is a perspective view showing a dial and a sleeve of the present invention.
Figure 9:
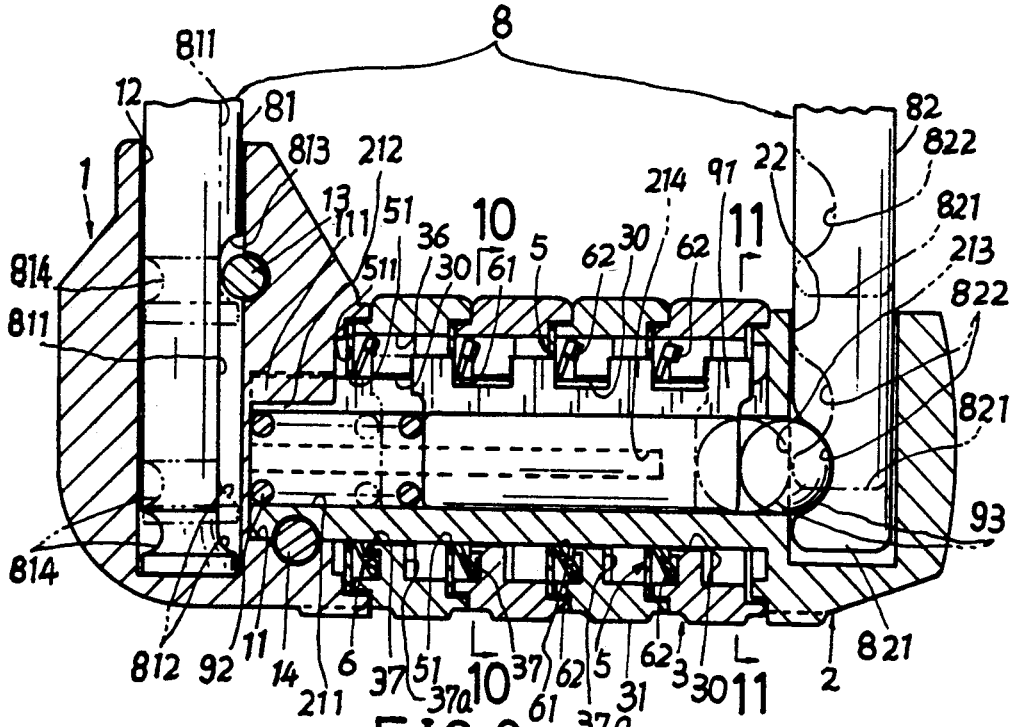
FIG. 9 shows an openable padlock of the present invention derived from FIG. 8.

For rotating the dials 3, the user may rotate the dial 3 and sleeve 4 by subsequently rotatably clicking the protrusion 62 of the sensing positioner plate 6 on each sensing recess 47 formed on each sleeve 4 to judge the dialing from one arabic number to next arabic number, thereby opening the lock by sense of feeling even at night without any illumination by a lock user or owner if the numeral 31 is made with three-dimensional extension such as "O" as shown in FIG. 6.

The combination-changing means 7 as shown in FIGS. 1, 2, 3 and 5 includes: at least a pin 7 longitudinally formed in the first lock body 1 and slidably held in a pin hole 10 formed through the body 1 having an innermost end 70 of the pin 7 normally touching the annular shoulder portion 45 of the sleeve 4 (for instance, a left sleeve 4), and a contracted pin end 71 formed on an outer end of the pin 7 opposite to the innermost end 70 slidably engageable with a contracted pin hole 101 formed in a side portion of the lock body 1 communicating the pin hole 10 and an outside surface of the lock body 1, and a pin shoulder portion 72 defined between the pin 7 and the contracted pin end 71 engageable with an annular seat portion 102 between the contracted pin hole 101 and the pin hole 10. The pins 7 can also be eliminated so that an external needle can be accessibly inserted through the holes 101, 10 for depressing the sleeves 4 for changing combination. The pin hole 10 should be projectively deviated from the shackle hole 12.

The shackle 8 includes the first leg member 81 held in the first shackle hole 12 of the first lock body 1 and the second leg member 82 held in the second shackle hole 22 formed in the second lock body 2. The first leg member 81 is formed with a longitudinal recess 811 in a lower portion of the leg member 81 slidably engageable with the upper rivet 13 having a lower recess portion 812 and an upper recess portion 813 disposed on two end portions of the recess 811, and formed with an annular groove 814 in a lower periphery adjacent to a lowest end portion of the leg member 81 communicated with the lower recess portion 812.

When the shackle 8 is pulled upwardly for opening the lock as shown in dotted line of FIG. 2, the annular groove 814 is rotatably engageable with the rivet 13 for rotating the second leg member 82 for its unlocking from the second lock body 2, and is limited by the rivet 13 for preventing a further upwardly pulling of the leg member 81 to release from the lock body 1.

The locking means 9 includes: a locking bolt 90 generally cylindrical shaped slidably engageable with the central bolt hole 211 of the hollow spindle 21 having a plurality of projections 91 longitudinally formed and equally spaced on the locking bolt 90, a bolt tensioning spring 92 resiliently retained between a bottom wall of the spindle socket 11 and a first end portion of the bolt 90 proximate the first lock body 1, and a locking ball 93 rotatably retained on a second end portion of the bolt 90 engageable with an arcuate recess 822 formed in a lower end portion 821 of the second leg member 82. The locking ball 93 is rotatably limited by the two meniscus extensions 213 formed at the interface between the bolt hole 211 and the shackle hole 22 as shown in FIGS. 4 and 2. A spherical portion of the ball 93 protrudes beyond the bolt hole 211 into the shackle hole 22 should not exceed one half of a diameter of the ball 93 so that the ball 93 can be retained on meniscus extensions 213.

For opening the padlock of the present invention by rotating the dials 3 to the correct opening combination to match the opening slot 46 of each sleeve 4 with the projections 91 of the locking bolt 90, the shackle 8 is pulled upwardly to allow the arcuate recess 822 of the second leg member 82 of shackle 8 to urge the ball 93 inwardly to retract the bolt 90 in order to disengage the leg member 82 from the ball 93 until leaving the second shackle hole 22. The first leg member 81 is rotated by rotatably engaging the annular groove 814 with the rivet 13 to unlock the lower end portion 821 of the second leg member 82 from the second lock body 2 for opening the padlock.

For locking the padlock of the present invention, the shackle 8 is depressed downwardly to insert the second leg member 82 into the second shackle hole 22 to re-engage the arcuate recess 822 with the locking ball 93 which is resiliently restored rightwardly as urged by the bolt 90 and tensioning spring 92. The dials 3 are then rotated to confuse the opening combination to deviate the opening slot 46 of each sleeve 4 from the projection 91 of the locking bolt 90. At this time, a pulling action of the shackle trying to thrust the ball 93 and bolt 90 inwardly to open the lock will be in vain since the projection 91 is obstructed by the inner ring 44 of the sleeve 4, thereby locking the padlock as shown in FIG. 1.

Figure 7:
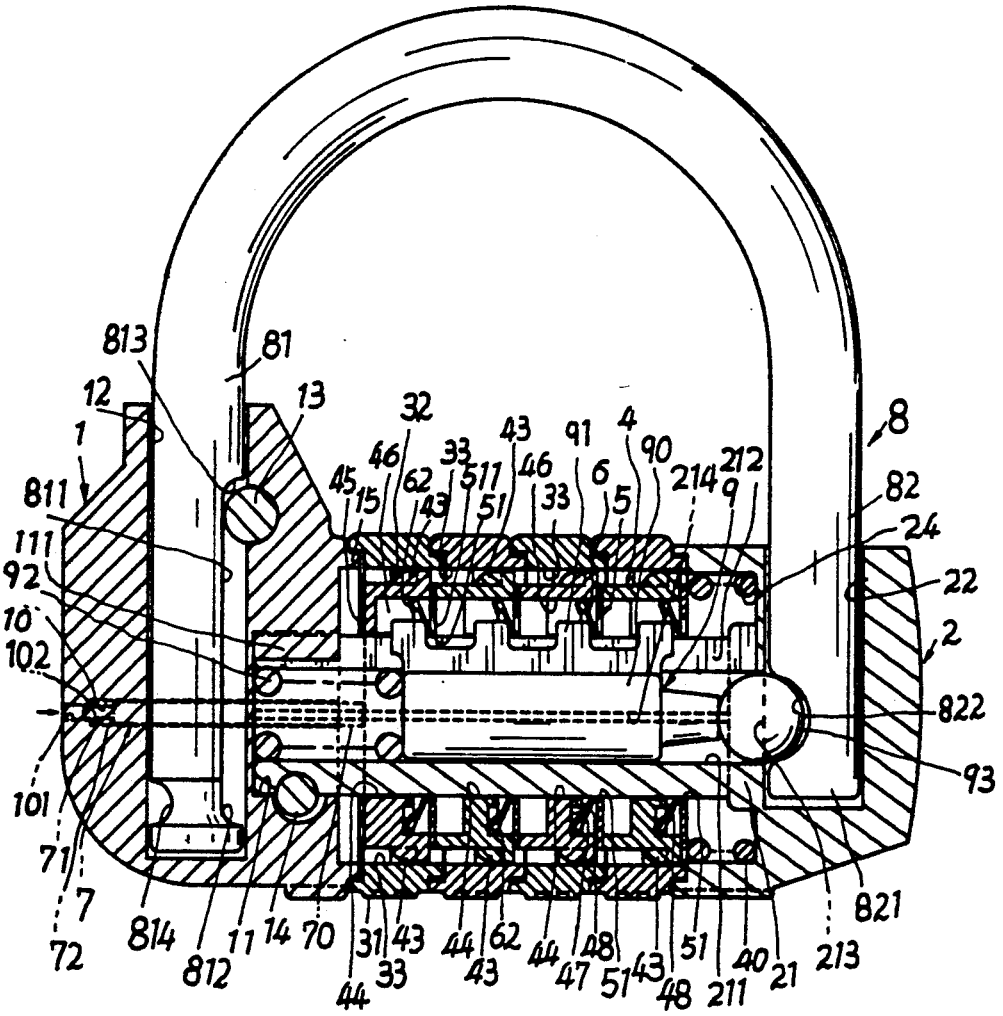
FIG. 7 is a sectional drawing of the present invention for changing a combination.

For changing or re-setting a new combination when the lock is opened, the pin 7 already formed in situ in the hole 10 or any other pin-like needle inserted in the hole 10 is depressed inwardly by a tool poking through the hole 101 to push the sleeves 4 rightwardly as shown in FIG. 7 against the tensioning spring 40 to disengage the sleeves 4 from the dials 3 so that the dials 3 can be optionally rotated for re-setting a new combination. Then, the pin 7 is released and the tensing spring 40 will restore the sleeves 4 leftwardly to re-engage the sleeves 4 with the dials 3 ready for next closing or opening operation.

Since each positioner plate 6 has two fixing protrusions 63 and each spacer 5 has two protrusions 52 formed on its two opposite sides of each central guide hole 61 or 51 respectively slidably engageable with two positioning grooves 214 longitudinally formed on two opposite sides of the spindle 21, so that each positioner plate 6 and each spacer 5 will be firmly held on spindle 21 of the lock body 2. Upon a pushing of the sleeve 4 as depressed by the pin 7 inwardly (rightwardly) as shown in FIG. 7 for changing the combination, the sleeves 4 retained by the "stable" plate 6 and spacer 5 will be firmly fastened between the pin(s) 7 under depression pressure and an elastic force acted by the sleeve tensioning spring 40, so that the dials 3 can be freely rotated for changing the combination individually without being rotatably coupled with the sleeves 4. Naturally, the protrusions 43 of the sleeve 4 have been disengaged from the recesses 33 of the dial 3 when depressing the pin 7 inwardly (FIG. 7), thereby ensuring a free rotation of the dials for smoothly changing the combination.

When the present invention is being locked and a thief tries to open the lock by rotating the dials 3 for a trial for sensing the opening slot 46 of each sleeve 4, he will pull the shackle 8 to thrust and retract the ball 93 and the locking bolt 90 to expect an engagement of each projection 91 with the opening slot 46 of the sleeve 4 during the rotation of dials 3. However, the projections 91 of bolt 90 are retarded against the recesses 47 of the sleeves 4 which can not be rotated cooperatively with the rotating dials 3, thereby ensuring a perfect security purpose of the present invention.

The present invention is superior to the inventor's earlier granted patent with a simpler but more reliable combination-changing operation and mechanism. Meanwhile, the elements in construction of the present invention are simplified to be a compact padlock for convenient operation and handling, and also for reducing installation or assembly jobs, reducing production cost and maintenance problems therefore.

Another preferred embodiment of the present invention is shown in FIGS. 8–12.

Figure 12:
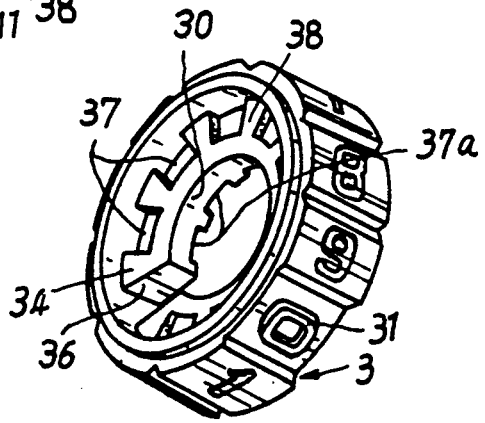
FIG. 12 is a perspective view of a dial of the present invention as shown in FIGS. 8, 9.
Figure 11:
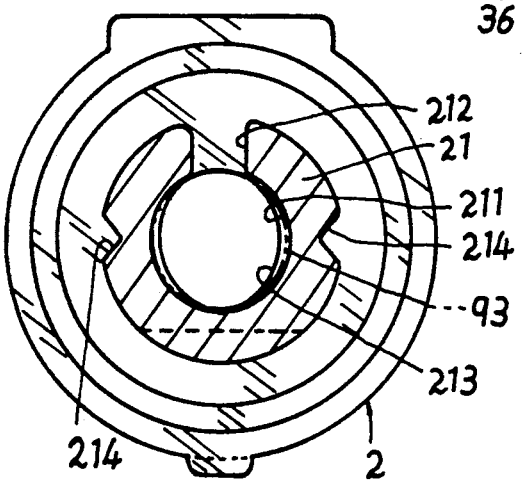
FIG. 11 is an illustration of the present invention as viewed from 11—11 direction of FIG. 9.

For further simplifying the construction of the present invention, the dial 3 and the sleeve 4 as aforesaid can be simply modified to be a dial 3 as shown in FIG. 12, which includes: a central hole 30 rotatably engageable with the spindle 21, a plurality of numerals 31 formed on an outer cylindrical surface of the dial 3, an inner ring 34 formed inside the dial 3 defining the central hole 30, an opening slot 36 formed through the inner ring 34 corresponding to the longitudinal slot 212 of the spindle 21 for slidably moving the plurality of projections 91 formed on the locking bolt 90, a plurality of dial-sensing recesses 37 and corrugated teeth 38 annularly formed on the inner ring 34.

Every two neighbouring dials 3 are partitioned by each spacer 5. Each sensing positioner plate 6 is resiliently retained between each spacer 5 and the inner ring 34 of each dial 3. The sleeve tensioning spring 40 and spring socket 24 as aforesaid are now omitted. The combination-changing means 7 in FIGS. 8–12 is also eliminated to simplify the construction for saving cost.

The locking or opening operation of this embodiment (FIGS. 8–12) is similar to that as aforementioned, and is therfore no longer described. The present invention may be suitably modified by those skilled in the art, without departing from the spirit and scope of this invention.

Figure 8:
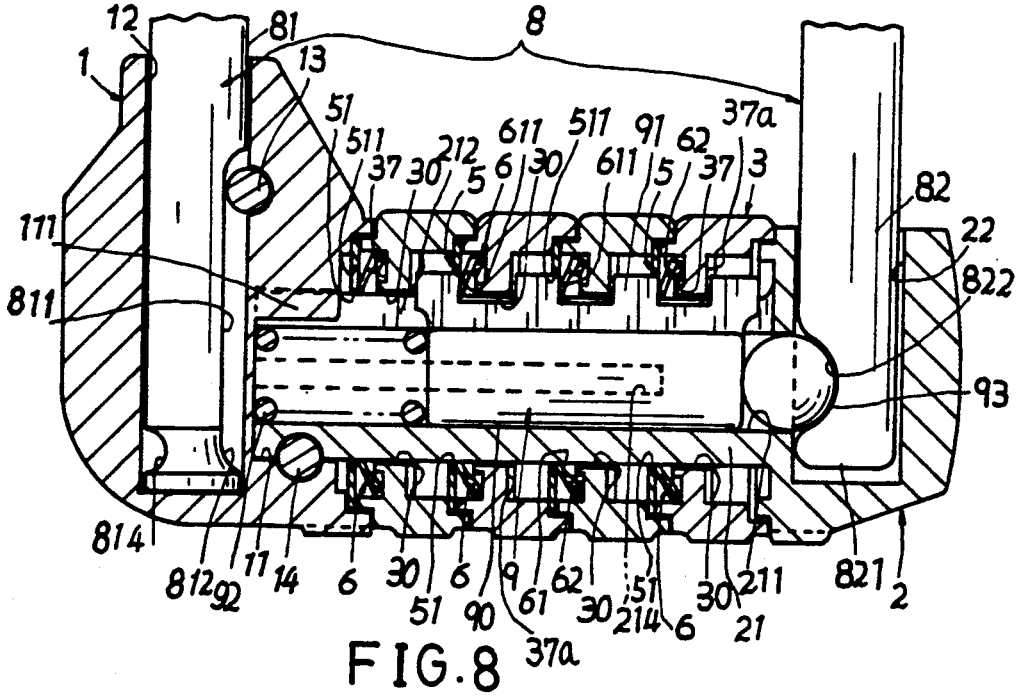
FIG. 8 is a sectional drawing of another preferred embodiment of the present invention when locked.
Figure 10:
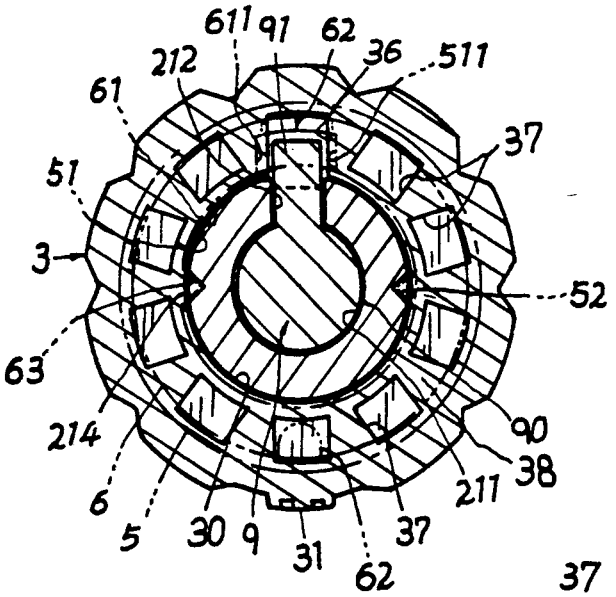
FIG. 10 is a sectional drawing of the present invention as viewed from 10—10 direction of FIG. 9.

As shown in FIGS. 8 and 12 of the second preferred embodiment of this invention, each dial 3 is annularly formed with a plurality of anti-sensing recesses **37*a* in the inner ring 34 on an opposite surface to the dial-sensing recesses 37 so that when an intruder tries to rotate the dials for finding out the opening slots 36 of the dials 3, he will pull the shackle 8 to thrust and retract the ball 93 and bolt 90 to expect the projection 91 to engage the slot 36, and rotate the dials 3 for sensing each opening slot 36. However, the projections 91 of bolt 90 are retarded against the anti-sensing recesses 37*a* so that the dials 3** will not be rotated for ensuring a security purpose of the invention.

I claim:

1. A combination padlock comprising:

a first lock body having a first shackle hole vertically formed therein for slidably holding a first leg member of a shackle in said first shackle hole and having a spindle socket horizontally formed in an inner side portion of said first lock body;

a second lock body having a second shackle hole vertically formed in said second shackle body for slidably holding a second leg member of said shackle in said second shackle hole, and a hollow spindle protruding inwardly from said second lock body to be engageably secured with said spindle socket of said first lock body for combining said second lock body with said first lock body;

a plurality of sleeves longitudinally rotatably mounted on said hollow spindle;

a plurality of dials rotatably secured between said two lock bodies and respectively engageable with said sleeves;

a locking means slidably held in said hollow spindle, normally locking said second leg member of said shackle in said second lock body as retarded by said sleeves for locking said padlock, and operatively depressed for unlocking the shackle when not retarded by the sleeves for opening the padlock; and a combination-changing means formed in said first lock body for operatively disengaging said sleeves from said dials when unlocking said locking means for a free rotation of said dials for resetting a new combination;

said locking means including a locking bolt generally cylindrical shaped slidably engageable with a central bolt hole longitudinally formed in said hollow spindle of said second lock body, a plurality of projections longitudinally formed and equally spaced on said locking bolt slidably engageable with a longitudinal slot formed in said hollow spindle and engageable with an opening slot formed in an inner ring in each said sleeve, a bolt tensioning spring resiliently retained between said spindle socket of said first lock body and a first end portion of said locking bolt proximate said first lock body, and a locking ball rotatably retained on a second end portion of said locking bolt opposite to said first end portion for engageably locking an arcuate recess formed in a lower end portion of said second leg member of said shackle as resiliently urged by said bolt tensioning spring, each said projection on said locking bolt being operatively retarded on said inner ring of each said sleeve for preventing a depression and retraction of said locking bolt towards said first lock body for locking said second leg member of said shackle in said second lock body; and upon an engagement of said projection with said opening slot of each said sleeve, said locking ball and bolt being depressible for disengaging said second leg member of said shackle for opening the padlock; and said combination-changing means including: at least a pin longitudinally formed in the first lock body slidably held in a pin hole formed through the body first lock having an innermost end of the pin normally touching an annular shoulder portion of said sleeve, and a contracted pin end formed on an outer end of the pin opposite to the innermost end slidably engageable with a contracted pin hole formed in an outer side portion of the first lock body, and a pin shoulder portion defined between the pin and the contracted pin end engageable with an annular seat portion formed between said contracted pin hole and said pin hole.

2. A combination padlock comprising:

a first lock body having a first shackle hole vertically formed therein for slidably holding a first leg member of a shackle in said first shackle hole and having a spindle socket horizontally formed in an inner side portion of said first lock body;

a second lock body having a second shackle hole vertically formed in said second shackle hole for slidably holding a second leg member of said shackle in said second shackle hole, and a hollow spindle protruding inwardly from said second lock body to be engageably secured with said spindle socket of said first lock body for combining said second lock body with said first lock body;

a plurality of dials rotatably mounted on said hollow spindle; and a locking means slidably held in said hollow spindle and normally locking said second leg member of said shackle in said second lock body as retarded by said dials, and operatively depressible for unlocking the shackle for opening the padlock when not retarded by said dial;

said locking means including a locking bolt generally cylindrical shaped slidably engageable with a central bolt hole longitudinally formed in said hollow spindle of said second lock body, a plurality of projections longitudinally formed and equally spaced on said locking bolt slidably engageable with a longitudinal slot formed in said hollow spindle and engageable with an opening slot formed in an inner ring of each said dial, a bolt tensioning spring resiliently retained between said spindle socket of said first lock body and a first end portion of said locking bolt proximate said first lock body, and a locking ball rotatably retained on a second end portion of said locking bolt opposite to said first end portion for engageably locking an arcuate recess formed in a lower end portion of said second leg member of said shackle as resiliently urged by said bolt tensioning spring, each said projection on said locking bolt being operatively retarded on said inner ring of each said dial for preventing a depression of said locking bolt and for locking said second leg member of said shackle in said second lock body for locking said padlock; and the inner ring of each said dial annularly formed with a plurality of anti-sensing recesses in a surface of the inner ring to be engageable with said projection of said lock bolt for preventing a rotation of said dial when the padlock is locked.

* * * * *